United States Patent [19]

Suzuki et al.

[11] 4,395,597

[45] Jul. 26, 1983

[54] SPEAKER DIAPHRAGM ASSEMBLY AND A METHOD OF MANUFACTURING THE SAME

[75] Inventors: Kiyoaki Suzuki; Masaru Watanabe; Hisashi Yamamoto; Tomoharu Hayashi; Takuji Miura, all of Yokohama, Japan

[73] Assignee: Victor Company of Japan, Limited, Yokohama, Japan

[21] Appl. No.: 191,089

[22] Filed: Sep. 24, 1980

[30] Foreign Application Priority Data

| | | | |
|---|---|---|---|
| Sep. 25, 1979 | [JP] | Japan | 54-131402[U] |
| Sep. 25, 1979 | [JP] | Japan | 54-131406[U] |
| Sep. 25, 1979 | [JP] | Japan | 54-131407[U] |
| Sep. 29, 1979 | [JP] | Japan | 54-133938[U] |

[51] Int. Cl.[3] ..... H04R 7/02; H04R 9/06; H04R 31/00

[52] U.S. Cl. ..... 179/115.5 R; 179/181 F; 29/594; 181/170; 181/174

[58] Field of Search ..... 179/115.5 R, 115.5 ES, 179/181 R, 181 F; 181/DIG. 1, 167, 170, 174; 29/594

[56] References Cited

U.S. PATENT DOCUMENTS

| | | | |
|---|---|---|---|
| 2,124,834 | 7/1938 | Stenger | 181/170 |
| 2,905,260 | 9/1959 | Williams | 181/167 |
| 3,111,187 | 11/1963 | Barlow | 179/181 F |
| 3,285,364 | 11/1966 | Cohen | 181/167 |
| 3,834,486 | 9/1974 | Tsuge et al. | 181/170 |
| 4,190,746 | 2/1980 | Harwood et al. | 179/115.5 ES |
| 4,275,278 | 6/1981 | Sakurai et al. | 179/181 F |

FOREIGN PATENT DOCUMENTS

| | | | |
|---|---|---|---|
| 55-95496 | 7/1980 | Japan | 179/181 F |

OTHER PUBLICATIONS

*Wireless World,* Dec. 1958, pp. 564–569, "Rigidity of Loudspeaker Diaphragms–Advantages of Sandwich Construction", D. A. Barlow.

*Primary Examiner*—George G. Stellar
*Attorney, Agent, or Firm*—Lowe, King, Price & Becker

[57] ABSTRACT

A speaker diaphragm assembly comprises a body made of a foam resin, and a sound radiating surface portion integrally formed with the body. In one embodiment, the sound radiating surface portion is made of a foam resin the density of which is greater than that at the body. In another embodiment, the sound radiating surface portion comprises a thin layer made of a solid resin, which thin layer is welded to the body. The rear end portion of the body may be reinforced in the same manner. In another embodiment, a supporting member is attached to the side surface of the diaphragm body for increasing the efficiency in vibration transmission from the voice coil. In another embodiment, a ring-like recess is made in the side surface of the body for spaced electrical terminals, to which heat is transmitted from the voice coil via lead wires, from the body, while a sub cone having low thermal conductivity is sandwiched between the lead wires and the body.

30 Claims, 14 Drawing Figures

SPEAKER DIAPHRAGM ASSEMBLY AND A METHOD OF MANUFACTURING THE SAME

FIELD OF THE INVENTION

This invention generally relates to a speaker having a diaphragm, having a body made of a foam resin, and more particularly, the invention relates to an improvement in a diaphragm assembly for use with a hi-fi speaker, and to a method of manufacturing such a diaphragm assembly.

BACKGROUND OF THE INVENTION

In present cone type and other speakers, undulations occur in a characteristic curve of sound pressure level versus frequency. The undulations occur due to the shape of the speaker even though the diaphragm vibrates reciprocally. For instance, in a speaker having a vertex angle of 120 degrees and diameter of 8 inches, there is a peak of approximately 5 dB around 1 KHz, and a dip of approximately 10 dB around 6 KHz. The peak and dip are reduced as the vertex angle becomes large, and therefore, it is necessary to make the sound radiating surface flat in order to remove the influence of the shape. However, the resonant frequency of a speaker diaphragm, which is flat and has a constant thickness, is low compared to that of a cone type speaker. For instance, there is a drawback such that the first order resonant frequency of a cone type speaker of vertex angle of 120 degrees, thickness of 0.5 millimeters, and diameter of 8 inches, resides between 1 and 2 KHz, while the first order resonant frequency of a flat speaker diaphragm of the same thickness resides between 100 and 200 Hz. Therefore, when a flat speaker diaphragm is used, it is required to make both the diaphragm thickness and the flexural rigidity great. In addition it is desirable to manufacture a speaker diaphragm with a low density material in order to make the weight of the speaker diaphragm light. For this reason a low density material foam resins, such as foam styrene the density of which is between approximately 0.015 and 0.1 g/cm$^3$, have been used hitherto. However, when a speaker diaphragm is simply made of foam styrene or the like, it is necessary to use a high density material in order to obtain an adequate frequency range of the reciprocal movement thereof since the density of foam styrene has a proportional relationship with Young's modulus. Thereby the advantage of using a light foam resin for the speaker diaphragm may be lost and a necessary sound pressure level will not be obtained. To the contrary, if it is intended to obtain an adequate sound pressure level, it is necessary to use a foam resin of low density for the speaker diaphragm so that the frequency range of the reciprocal movement becomes narrow.

Although a speaker diaphragm assembly manufactured by adhering a sheet of paper to the sound radiating surface of a diaphragm was proposed in order to eliminate the above-mentioned drawbacks, an adequate adhesive force between the foam resin and the sheet of paper cannot be obtained with this speaker diaphragm assembly so that the sheet of paper easily comes off; an adequate stiffness cannot be obtained on the surface thereof; and the frequency range of the reciprocal movement cannot be satisfactorily widened.

Therefore, the present inventors tried to remove the above-mentioned drawbacks by changing the density of the foam resin as a function of location. The inventors made a speaker diaphragm with a foam resin, in such a manner that the density of the foam resin at the center portion of the diaphragm is greater than the density at the remaining portions, and the density decreases toward the periphery of the diaphragm. Although it was possible with such a speaker to expand the reproducible frequency range since a plurality of partial vibrations occurred in the middle and high frequency ranges, it was impossible to widen the frequency range of the reciprocal movement of the entire diaphragm. In other words, while it appeared that such a speaker having a low density foam resin at the sound radiating surface thereof, would have a widened reproducible frequency range, the actual flat range of the sound pressure level to frequency characteristic curve was not improved at all. Consequently, it can be said that such a speaker is not suitable for hi-fi sound reproduction.

The conventional diaphragm simply made of a foam resin and the resulting conventional speaker having such a diaphragm have other disadvantages as follows:

Namely, in a speaker using a diaphragm made of a relatively weak foam resin, such as a foam styrene resin, a foam acrylic resin, a foam urethane resin or the like, an aluminum foil is often secured to the center portion of the side surface of a speaker diaphragm or a light metallic plate is attached to the entire side surface of the speaker diaphragm in order to protect the diaphragm. However, in the speaker of the first-mentioned construction, the state of vibration transmission is not desirable since the vibrations of the voice coil are transmitted via the voice coil bobbin to only a joint portion between the voice coil bobbin and the diaphragm so that the sound quality is not particularly good. Furthermore, since the diaphragm, to which the vibrations are transmitted via the voice coil bobbin, is made of a foam resin, the diaphragm is relatively weak, whereby the efficiency of the vibration transmission from the voice coil bobbin is poor. In addition, another drawback is that it is troublesome to adhere the aluminum foil only to the center portion of the side surface of the diaphragm. On the other hand, in the latter-mentioned speaker, although the above-mentioned drawbacks are reduced, since the light metallic plate is attached to the entire side surface of the speaker diaphragm, the weight of the vibrating system increases to reduce the vibration efficiency of the speaker diaphragm. As a result, an adequate sound pressure level cannot be obtained and the speaker suffers from poor sound quality.

Another drawback inherent to such a conventional speaker is that foam resin speaker diaphragm, has a poor heat-resisting characteristic; the diaphragm melts because a joint portion between the voice coil bobbin and the speaker diaphragm gets sufficiently hot in response to heat generated in the voice coil that is transmitted via the voice coil bobbin to the speaker diaphragm. For this reason, it is impossible to drive such a speaker with high power. Furthermore, since tinsel codes for establishing electrical connections between speaker terminals and the voice coil are disposed close to the damper, the tinsel codes and the damper abut against each other due to the vibrations resulting in the occurrence of rustles so that the sound quality becomes poor.

SUMMARY OF THE INVENTION

The present invention has been developed in order to remove the above-mentioned various drawbacks and disadvantages inherent in the conventional speaker diaphragm made of a foam resin.

It is, therefore, a primary object of the present invention to provide a speaker diaphragm assembly providing a wide frequency range of the reciprocal movement, while the diaphragm assembly is light in weight and is capable of delivering a high sound pressure level.

One of the features of the present invention is to provide a speaker having a diaphragm assembly with a body made of a foam resin, in which the vibrations of the voice coil bobbin can be effectively transmitted to the diaphragm body.

Another feature of the present invention is to provide a speaker having a diaphragm body made of a foam resin, in which the diaphragm is not damaged due to the heat generated in the voice coil when driven with a high power input.

A further feature of the present invention is to provide a speaker having a diaphragm with a body made of a foam resin, in which the occurrence of rustles caused by the contact between the tinsel codes connected to the voice coil lead wires, and the damper, are prevented.

In accordance with the present invention there is provided a speaker diaphragm assembly comprising: (a) a body made of a foam resin, the body having front and rear end portions; and (b) a sound radiating surface portion integrally formed with the front end portion of the body, and sound radiating surface portion being made of the same sort of resin as the foam resin, the density of the resin at the sound radiating surface portion being greater than that at the inside of the body.

In accordance with the present invention there is also provided a speaker comprising: (a) a housing; (b) a magnetic circuit means for constituting a magnetic gap, the magnetic circuit means being fixedly connected to the housing; (c) a voice coil wound around a voice coil bobbin, the voice coil bobbin being reciprocally movable in the magnetic gap; (d) electrical circuits for establishing electrical connections between the voice coil and speaker terminals; (e) a damper connected between the voice coil bobbin and the housing; and (f) a diaphragm assembly having a body made of a foam resin, a sound radiating surface portion, and a supporting member, the body having front end portions integrally formed with the sound radiating surface portion, a rear end portion, and a side surface extending between the sound radiating surface portion and the rear end portion, the rear end portion being fixedly connected to one end of the voice coil bobbin, the supporting member having one end connected to the voice coil bobbin and extending toward the sound radiating surface portion along the side surface to terminate at a point between the sound radiating surface portion and the rear end portion so that the supporting member covers half or less than half of the entire side surface, the supporting member being fixedly connected to the side surface to cover a portion of the side surface close to the rear end portion.

In accordance with the present invention there is also provided a method of manufacturing a speaker diaphragm made of a foam resin, comprising the steps of: (a) putting a first raw foam resin material having a relatively small foam magnification in a mold constructed of a lower mold for forming a sound radiating surface of the speaker diaphragm, an upper mold extending upwardly from the lower mold, and a cap to be inserted in a hole made in the upper mold; (b) putting a second raw foam resin material having a relatively great foam magnification in the mold in such a manner that the second raw material is placed on the first raw material; (c) tightening the cap; and (d) heating the mold to foam the first and second raw materials so that there is obtained a speaker diaphragm having the sound radiating surface with a foam resin density greater than that at the inside of the speaker diaphragm.

In accordance with the present invention there is also provided a method of manfucturing a speaker diaphragm, comprising the steps of: (a) placing a thin layer made of a resin on a lower mold to form a sound radiating surface of the diaphragm; (b) placing an upper mold on the lower mold, the upper mold extending upwardly and having a hole at the top thereof for receiving a cap; (c) putting a raw material of a foam resin of the same sort as said resin in the upper mold in such a manner that the raw material is placed on the thin layer; (d) tightening the cap; and (e) heating the upper and lower molds to foam the raw material so that the thin layer is welded to the body of the diaphragm made of the foam resin.

BRIEF DESCRIPTION OF THE DRAWINGS

These and other objects and features of the present invention will be more readily apparent from the following detailed description of the preferred embodiments taken in conjunction with the accompanying drawings in which.

DETAILED DESCRIPTION OF THE PREFERRED EMBODIMENT

Figure 1:
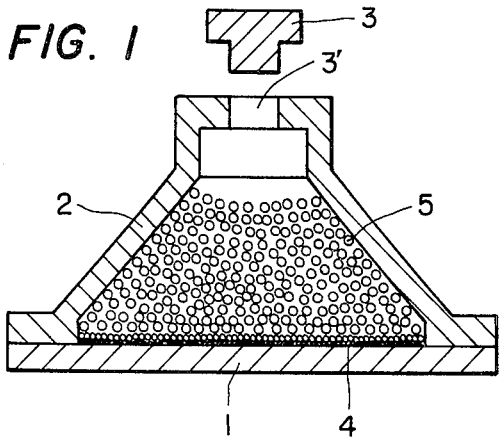
FIG. 1 is a cross-sectional view of a mold used in a manufacturing process of a first embodiment of a speaker diaphragm assembly according to the present invention.

In FIG. 1 is illustrated a mold for manufacturing a first embodiment speaker diaphragm assembly according to the present invention; the process of manufacturing the same is described with reference to FIG. 1. The mold comprises a lower mold 1, which is substantially flat, an upper mold 2, which is upwardly extending from the lower mold 1, and a cap 3. The cap 3 is arranged to be inserted into an opening 3' made at the top of the upper mold 2. The upper mold 2 has a substantially truncated conical shape and is hollow to form a substantially truncated conical speaker diaphragm therein. If desired, however, other shapes may be used.

Initially, a first foam resin material 4 having a relatively small foam magnification and preferably formed of beads is put in the mold through the opening 3' so it rests on the upper surface of the lower mold 1. Then a second raw foam resin material 5, formed of beads, having a relatively great foam magnification is put in the mold through the opening 3' so that the second raw material 5 rests on the above-mentioned first raw material 4. The first and second raw materials may be a styrene resin, an acrylic resin, a urethane resin or the like. However, the same sort of resin should be used for the first and second raw materials so that these two raw materials melt to be welded to each other when heated as described infra.

Since the volumes of the first and second raw materials 4 and 5 increase as the materials foam, the amount of the second raw material 5 put in the mold is such that there is a given volume left at the top in the chamber defined by the upper mold 2 as shown in FIG. 1. After a given amount of the second raw material beads 5 is put in the mold, the cap 3 is inserted in the opening 3' to be tightened. Then the entire mold is heated to approximately 100 to 120 degrees centrigrade. As a result of heating, the first and second raw materials 4 and 5 foam to form an integral diaphragm assembly. As the first and second raw material beads 4 and 5 foam with heat, these two groups of beads 4 and 5 are welded to each other.

Figure 2:
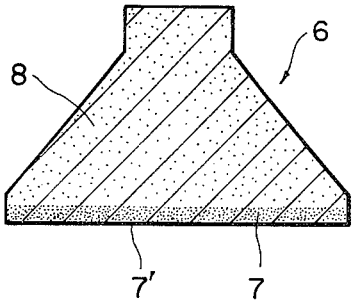
FIG. 2 is a schematic cross-sectional view of the first embodiment speaker diaphragm assembly manufactured by means of the mold of FIG. 1.

FIG. 2 is a schematic cross-sectional view of the speaker diaphragm assembly 6 manufactured by the above described process. Namely, a flat sound radiating surface portion 7 having a flat surface 7' is formed of a first foam resin, such as a styrene resin, corresponding to the first raw material 4. Portion 8 of assembly 6 other than and above sound radiating surface portion 7, is defined as a body of the speaker diaphragm assembly 6. The body 8 has a front end portion to which the sound radiating surface portion 7 is welded, a rear end portion at the opposite side with respect to the front end portion for receiving vibrating forces from a voice coil bobbin (not shown), and a side surface extending from the rear end portion to the periphery of the sound radiating surface portion 7.

Since the sound radiating surface portion 7 and the body 8 are respectively made of the first and second raw materials having different foam magnifications, the density of the foam resin in the sound radiating surface portion 7 is greater than that in the body 8 of the diaphragm assembly 6. It is preferable that the density of the sound radiating surface portion 7 be equal to or greater than approximately 0.04 g/cm$^3$; the preferred density is from 0.05 to 0.1 g/cm$^3$. On the other hand, it is preferable that the density of the body 8 be equal to or less than approximately 0.03 g/cm$^3$; the preferred density is between approximately 0.01 and 0.03 g/cm$^3$. The high density sound radiating surface portion 7 is required to have a given thickness measured from the sound radiating surface 7', namely, the thickness of portion 7 is preferably such that an adequate frequency range of the reciprocal movement is obtained and an adequate sound pressure level is obtained. For instance, in case of a truncated conical speaker diaphragm assembly having a foam resin body 8 with a first density of approximately 0.02 g/cm$^3$ a sound radiating surface portion 7 with a second density of approximately 0.05 g/cm$^3$, a diameter of 30 centimeters, and a height of 63 centimeters, it is preferable that the thickness of the sound radiating surface portion 7 be approximately between 5 and 10 millimeters so that the frequency range of the reciprocal movement is sufficiently wide and an adequate sound pressure level is obtained.

Figure 3:
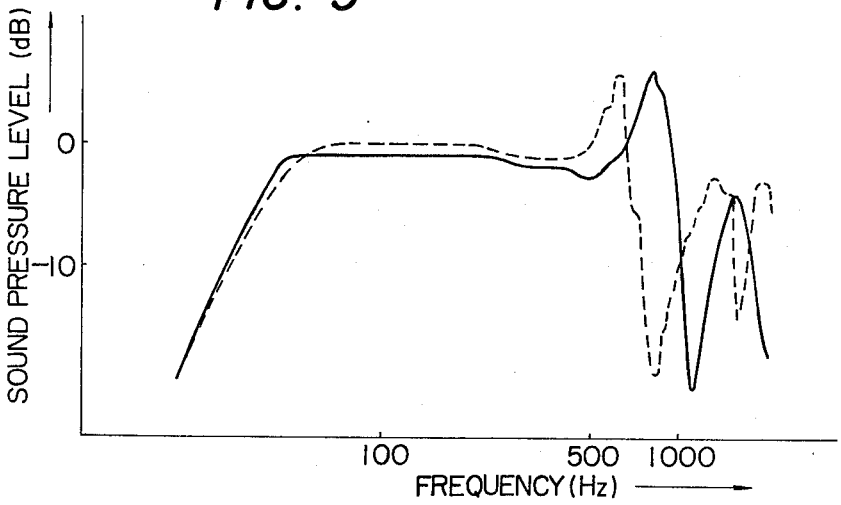
FIG. 3 is a graph of the sound pressure level versus frequency characteristics of an otherwise conventional speaker having the first embodiment diaphragm assembly.

Namely, as shown in FIG. 3, when measuring the sound pressure level versus frequency characteristic of a speaker including diaphragm assembly 6, a peak occurs in the vicinity of approximately 800 Hz (see the solid line of FIG. 3). On the contrary, when a speaker diaphragm is uniformly made of foam styrene having a density of approximately 0.02 g/cm$^3$, a similar peak occurs in the vicinity of approximately 600 Hz (see the dotted line of FIG. 3). From the comparison between these two curves it will be understood that the frequency range of the reciprocal movement of the speaker diaphragm assembly has been widened by making the density of the foam resin at the sound radiating surface portion 7 higher than that of the body 8 of the diaphragm assembly 6.

Furthermore, the compressive strength at the sound radiating surface portion 7 of the speaker diaphragm assembly 6 according to the present invention is great so that the speaker diaphragm assembly 6 is difficult to damage, while the sound radiating surface 7' has few undulations and thus superior sound quality.

Figure 4:
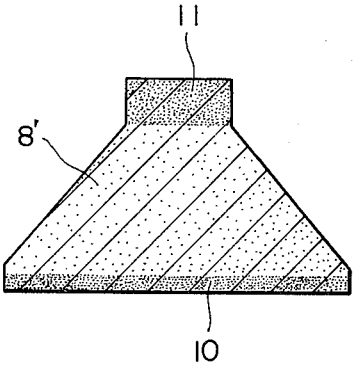
FIG. 4 is a schematic cross-sectional view of a second embodiment of a speaker diaphragm assembly according to the present invention.

Reference is now made to FIG. 4, a schematic cross-sectional view of a second embodiment of the speaker diaphragm assembly according to the present invention. The second embodiment diaphragm assembly differs from the first embodiment in that a rear end portion 11 of the body 8' of the diaphragm assembly is made stiff in the same manner as the sound radiating surface portion 7. The rear end portion 11, which is opposite to the front end 10 of the body 8' (the front end is integrally formed with the sound radiating surface portion 7) is connected to a voice coil bobbin (not shown) for receiving the vibrating forces therefrom.

In order to manufacture the above-mentioned second embodiment diaphragm assembly a third raw foam resin material (not shown) of the same sort as that of the first and second raw materials 4 and 5 used for the sound radiating surface portion 7 and the inside of the body 8', is put in the mold of FIG. 1 in such a manner that the third raw material rests on the second raw material 5 before inserting the cap 3 into the opening 3'. The foam magnification of the third raw material is smaller than that of the second raw material 5 so that the rear end portion 11 of the diaphragm assembly of the second embodiment of FIG. 4 becomes stiffer than the body 8'.

With this arrangement the second embodiment diaphragm assembly is difficult to damage when it receives vibrating forces from the voice coil bobbin. Furthermore, the frequency range of the reciprocal movement becomes wider because of the increase in stiffness.

As described above, in accordance with the first and second embodiments of the present invention because the density at the sound radiating surface portion 7 is greater than that of the inside of the speaker foam resin diaphragm assembly made, it is possible to provide a speaker diaphragm assembly having a wider frequency range for reciprocal movement than that of the conventional speaker diaphragm assembly. In addition since the assembly is light weight, an adequate sound pressure level can be obtained. Furthermore, since the density of the sound radiating surface portion 7 of the speaker diaphragm assembly is high, the compressive strength of the surface 7', which is located outside of the speaker enclosure (not shown) is superior so that the speaker diaphragm assembly is difficult to damage. Also, the speaker diaphragm assembly according to the above-described first and second embodiments has other advantages, such that the sound quality is superior since the sound radiating surface 7' has fewer undulations and thus is flat.

Figure 5:
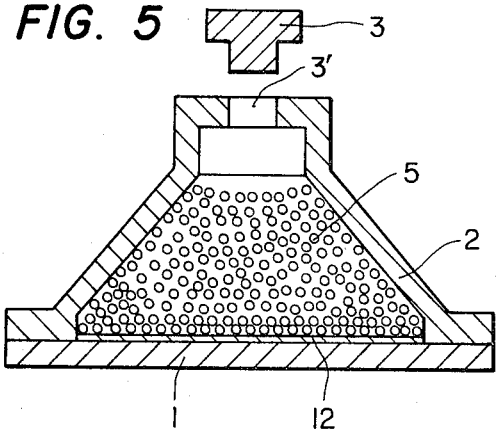
FIG. 5 is a cross-sectional view of a mold used in a manufacturing process of a third embodiment speaker diaphragm assembly according to the present invention.

FIG. 5 is a cross-sectional view of a mold comprising a lower mold 1, an upper mold 2, and a cap 3 in the same manner as the mold of FIG. 1; in FIG. 5 is shown the process of manufacturing a third embodiment speaker diaphragm assembly.

Initially, the upper mold 2 is removed from the lower mold 1. Thus, only the lower mold 1 and a thin layer or sheet 12 made of a resin are placed on the front surface of the lower mold 1. It is to be noted that the thin layer 12 is not made of a foam resin but is made of a solid resin, such as a styrene resin, an acrylic resin, a urethane resin or the like. For instance, a resin sheet or plate known as "HI-IMPACT STYROLE" (trademark) may be used as the thin layer 12. The thin layer 12 is placed at the center of the lower mold 1 so that the peripheral portion of the upper surface of the lower mold 1 is not covered by the thin layer 12. Then the upper mold 2 is placed on the lower mold 1 and is fixed to the lower mold 1 by means of a fastening means (not shown). A beaded, raw foam resin material 5, which is the same sort as the resin of the thin layer 12, is put in the mold chamber through the opening 3' located at the top of the upper mold 2 in such a manner that the raw material 5 is placed on the thin layer 12. The cap 3 is inserted in the opening 3' and is tightened and then the entire mold is heated to approximately 100 to 120 degrees centigrade in the same manner as described in connection with the first embodiment.

Figure 6:
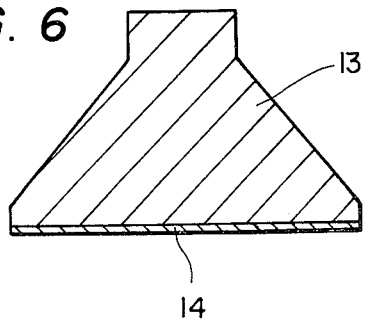
FIG. 6 is a schematic cross-sectional view of the third embodiment of a speaker diaphragm assembly manufactured by means of the mold of FIG. 5.

The raw material 5 foams and melts, while the thin layer 12 melts with heat. Accordingly, the thin layer 12 is welded to the front surface of the body 13 of the diaphragm assembly as shown in FIG. 6. Namely, the thin layer 12 turns to a sound radiating surface 14 of the speaker diaphragm assembly. The stiffness of the thin layer 12 is preferably greater than that of the foam resin used for the body 13 of the diaphragm assembly; it is preferable that the thickness of the thin layer 12 be less than 0.6 millimeters, for instance between 0.2 and 0.5 millimeters.

Since the body 13 and the sound radiating surface portion 14 of the speaker diaphragm assembly are made of a resin of the same sort, the adhesive force between members 13 and 14 is great enough to prevent the sound radiating surface portion 14, which actually comprises the thin layer 12, from coming off even though roughly treated. The third embodiment diaphragm assembly has an advantage that the thin layer 12 can be secured to the body 13 without using an adhesive agent since these two members 12 and 13 are welded to each other as described above. Therefore, a large number of speaker diaphragm assemblies can be readily manufactured by the above-mentioned method.

Figure 7:
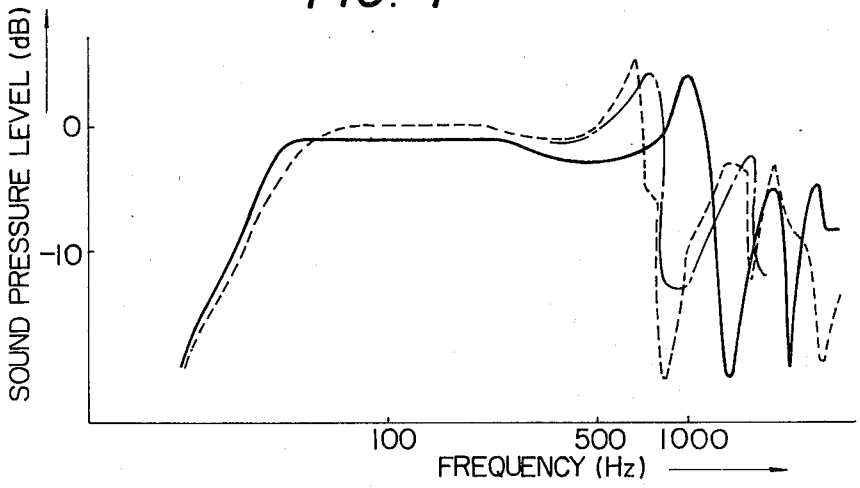
FIG. 7 is a graph of a sound pressure level versus frequency characteristics of an otherwise conventional speaker having the third embodiment diaphragm assembly.

Reference is made to FIG. 7, a plot of the sound pressure level versus frequency measured characteristic of the third embodiment speaker diaphragm assembly manufactured in the above-mentioned manner. In FIG. 7, the solid line indicates the response for the third embodiment of the present invention; the dotted line indicates the response for a truncated conical speaker diaphragm assembly made of a foam resin having no thin layer attached to the body; the dot-dash line indicates the response for a truncated conical speaker diaphragm assembly made of a foam resin having a sheet of paper attached to the body. The results of the measurements show that a speaker diaphragm assembly having no thin layer or a thin layer made of a paper sheet has a narrow frequency range for reciprocal movement; for instance, a peak occurs in the vicinity of approximately 600 Hz, so that the operational frequency range of the speaker is extremely narrow. On the other hand, in case of the third embodiment speaker diaphragm assembly according to the present invention, a peak occurs in the vicinity of approximately 1 KHz where the height of this peak is low so that there is a wide frequency range of reciprocal movement and thus the operational frequency range of a speaker having the third embodiment diaphragm assembly is wide accordingly.

Furthermore, as the body of the speaker diaphragm assembly is made of a foam resin, a light speaker diaphragm assembly as well as an adequate sound pressure level can be obtained.

Figure 8:
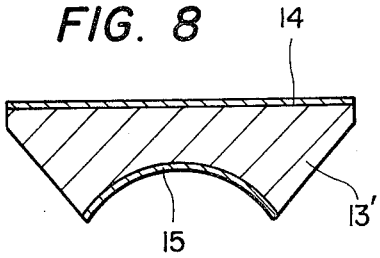
FIG. 8 is a schematic cross-sectional view of a fourth embodiment of a speaker diaphragm assembly according to the present invention.

Reference is now made to FIG. 8, a schematic cross-sectional view of a fourth embodiment of a speaker diaphragm assembly according to the present invention. The fourth embodiment diaphragm assembly comprises a body 13' and a sound radiating surface 14 which are manufactured in the same way as the third embodiment of FIG. 6. The fourth embodiment differs from the third embodiment in that the rear end portion of the body, which is opposite to the front end to which the sound radiating surface portion 14 is connected, is convexly curved to receive a convexly curved thin layer or sheet 15. This thin layer 15 is also made of a resin which is the same sort as the resin used for the body 13' so that the thin layer 15 is welded to the rear portion of the body 13' simultaneously with the above described heating process. In order to manufacture the above-mentioned fourth embodiment speaker diaphragm assembly a dome-like shaped thin layer of a resin is placed on the raw material 5 of FIG. 5. With the provision of the thin layer 15 at the rear portion of the body 13' the stiffness at the rear portion increases so that there is a further widening of the frequency range of the reciprocal movement.

As described above, in accordance with the third and fourth embodiments of the present invention, since the thin layer 12 is made of the same sort resin as that of the speaker diaphragm welded to the front surface of the speaker diaphragm, the thin layer 12 which functions as the sound radiating surface portion 7 is strongly secured to the speaker diaphragm body 13 without an adhesive agent, so that the assembly is lighter by an amount as much as the weight of an adhesive agent; further the sound pressure level is increased by an amount as much as the reduction in weight. Furthermore, since the speaker diaphragm body 13 is made of a foam resin, the speaker diaphragm assembly is light in weight, providing an adequate sound pressure level, while the surface of the speaker diaphragm assembly has a sufficient stiffness to make the frequency range wide and thus the sound quality is improved.

Conventional speakers are now described with reference to FIG. 9 and FIG. 10 for a better understanding of the objects and construction of the fifth embodiment.

Figure 9:
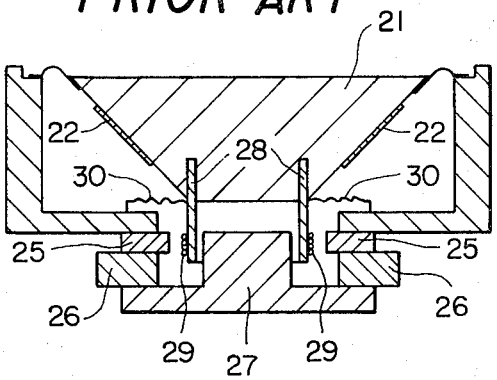
FIG. 9 PRIOR ART
FIG. 9 is a schematic cross-sectional view of a conventional speaker.
Figure 10:
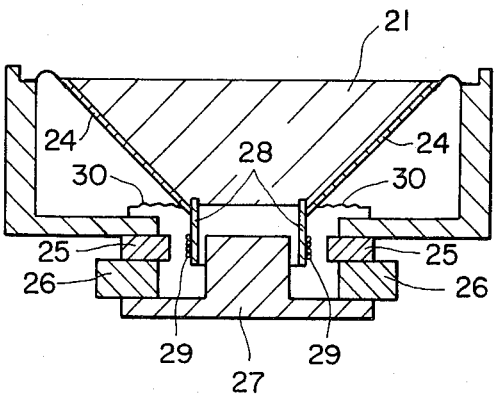
FIG. 10 PRIOR ART
FIG. 10 is a schematic cross-sectional view of another conventional speaker.

In a conventional speaker having a diaphragm made of a foam resin, as shown in FIG. 9, the diaphragm is reinforced by securing an aluminum foil 22 to the center portion of the side surface of a diaphragm 21; alternatively, as shown in FIG. 10, a light metallic plate 24 is placed on the entire side surface of the diaphragm so that the diaphragm 21 is not damaged when roughly treated or when driven by a high power input. The speakers of FIG. 9 and FIG. 10, include a top plate 25, an annular magnet 26, a yoke 27, a voice coil bobbin 28, a voice coil 29, and a damper 20. However, in the speaker of these constructions, for instance in the speaker of FIG. 9, the vibration transmission efficiency is not desirable since the vibrations of the voice coil 29 are transmitted via the voice coil bobbin 28 to only the joint portion between the voice coil bobbin 28 and the diaphragm 21 so that high sound quality cannot be expected. Furthermore, the strength of the speaker diaphragm 21 is small because the diaphragm is made of a foam resin, another reason why the vibration transmission efficiency is poor. In addition, another drawback occurs because it is troublesome to secure the aluminum foil 22 only to the center portion of the side surface of the diaphragm 21. While the speaker shown in FIG. 10 reduces the above-mentioned drawbacks, since the light metallic plate 24 is attached to the entire side surface of the speaker diaphragm 24, the weight of the vibrating system becomes heavier accordingly so that the vibration efficiency of the speaker diaphragm 21 lowers. As a result, an adequate sound pressure cannot be obtained, resulting in poor sound quality.

The fifth embodiment of the present invention, described with reference to FIG. 11 and FIG. 12, aims to remove the above-mentioned drawbacks.

Figure 11:
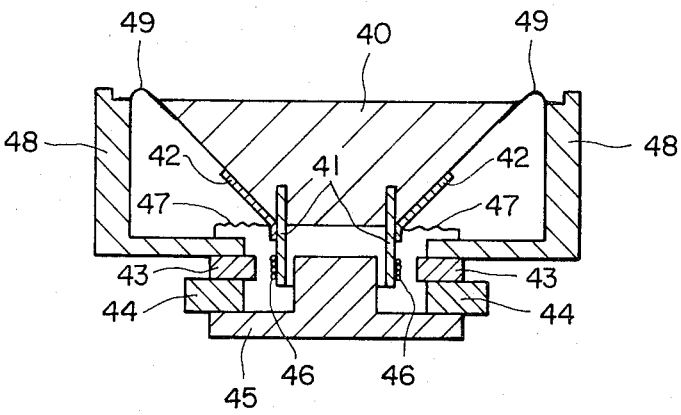
FIG. 11 is a schematic cross-sectional view of a speaker including a fifth embodiment speaker diaphragm assembly according to the present invention.
Figure 12:
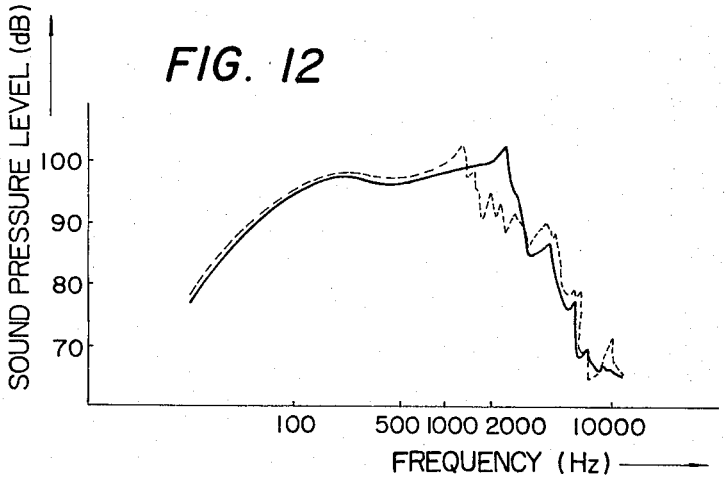
FIG. 12 is a graph of the sound pressure level versus frequency characteristics of the speaker of FIG. 11 and of a conventional speaker.

FIG. 11 is a schematic cross-sectional view of a speaker having a diaphragm assembly according to the fifth embodiment of the present invention. The speaker comprises a housing 48, a top plate 43, an annular magnet 44, a yoke 45, a voice coil 46 wound around a voice coil bobbin 41, a damper 47, and an edge member 49, and a diaphragm assembly 40 which may be the same as in one of the above-described four embodiments. The top plate 43, the annular magnet 44 and the yoke 45 constitute a magnetic circuit having a magnetic gap; these members constituting the magnetic circuit are fixedly supported by the housing 48. One end of voice coil bobbin 41 is fixedly connected to the rear end portion of the diaphragm assembly 40 and is arranged to be reciprocally moved in the magnetic gap. The damper 47 is connected between the voice coil bobbin 41 and the housing 48, while the edge member 49 is connected between the periphery of the sound radiating surface portion and the housing 48. While the diaphragm assembly 40 comprises a body made of a foam resin, it also comprises a supporting member 42 which is made of a light and stiff material, such as paper, a light metal or a synthetic resin. One end of the supporting member 42 is connected to the voice coil bobbin 41. The supporting member 42 extends toward the sound radiating surface portion along the side surface of the body to terminate at a point between the sound radiating surface portion and the rear end portion so that the supporting member 42 covers half or less than half of the entire side surface. The supporting member 42 is fixedly adhered to the side surface by means of a suitable adhesive agent.

The supporting member 42 does not cover the entire side surface of the body of the diaphragm assembly 40 because the vibrating system tends to be too heavy if the supporting member 42 is too large, and if so, an adequate sound pressure cannot be obtained, partial vibrations would occur, and thus the sound quality would deteriorate. It is preferable that the thickness of the supporting member 42 be such that the vibrations of the voice coil 46 are effectively transmitted via the voice coil bobbin 41 and the supporting member 42 to the foam resin speaker diaphragm body; for instance, member 42 has a thickness of approximately 1 millimeter in case of paper, and approximately from 30 to 50 micrometers in case of an aluminum plate or the like. If the supporting member 42 is too thin, the vibrations of the voice coil 46 cannot be efficiently transmitted to the speaker diaphragm body. On the contrary, if supporting member 42 is too thick, the weight of the vibrating system is heavy so that an adequate sound pressure level cannot be obtained and thus the sound quality is poor.

In the speaker constructed in this manner, since the up-and-down vibrations in the voice coil 46 are transmitted via the voice coil bobbin 41 and the supporting member 42 to the large area of the speaker diaphragm assembly 40, the vibration efficiency transmission from the voice coil 41 to the speaker diaphragm assembly 40 is superior. The vibration transmission area in the speaker diaphragm assembly 40 is large compared to the speaker shown in FIG. 9 so that there is superior vibration transmission from the voice coil 41 to the speaker diaphragm assembly 40, resulting in superior sound quality. Furthermore, since the supporting member 42 causes the strength of the speaker diaphragm body to be increased, so the speaker diaphragm is difficult to damage; in addition the frequency range of the reciprocal movement of the speaker diaphragm assembly 40 is relatively wide. Namely, a comparison of the measured sound pressure level versus frequency characteristics of the speaker of FIG. 11 according to the present invention and of a speaker having no supporting member 42, as shown in FIG. 12, indicates a peak occurs in the vicinity of approximately 2,500 Hz in case of the speaker of FIG. 11 (shown by a solid line), and a like peak occurs in the vicinity of approximately 1,100 Hz in case of a speaker having no supporting member (shown by a dotted line). Furthermore, when comparing the speaker of FIG. 10 with the speaker of FIG. 11 according to the present invention, the weight of the vibrating system of the speaker of FIG. 10 is greater than that of the speaker having the fifth embodiment diaphragm assembly, so that the vibrations of the voice coil in the speaker of FIG. 10 are not transmitted to the speaker diaphragm sufficiently, and the sound pressure is low; furthermore the sound quality is poor such that partial vibrations occur.

The supporting member 42 may be integrally formed with the voice coil bobbin 41 instead of securing them to each other, if desired.

As described above, in accordance with the fifth embodiment, since the supporting member 42 is installed only at the edge portion, close to the voice coil bobbin 41, of the side surface of a foam resin diaphragm body in such a manner that the supporting member 42 abuts against the voice coil bobbin 41 and the diaphragm body, the strength of the diaphragm body is increased; the diaphragm body is difficult to damage; the reciprocal movement frequency range is wide; furthermore, the vibrations of the voice coil 46 are effectively transmitted to the diaphragm body; undesirable partial vibrations do not occur; the sound quality is superior; the vibrating system is light in weight; an adequate sound pressure is obtained; and other advantages are attained.

Although a sixth embodiment of the present invention will be described infra with reference to FIG. 14, reference is now made to FIG. 13, a diagram of a conventional speaker; the description of FIG. 13 includes drawbacks of the conventional speaker to enable the objects of the sixth embodiment to be readily understood.

Figure 13:
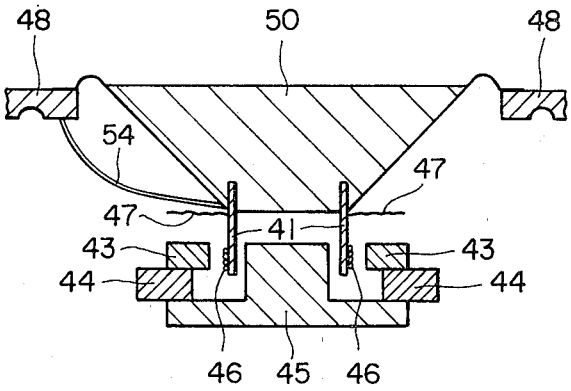
FIG. 13 PRIOR ART
FIG. 13 is a schematic cross-sectional view of a conventional speaker.

As shown in FIG. 13, a conventional speaker includes a voice coil bobbin 41 installed at the rear end portion of a substantially truncated conical foam resin speaker diaphragm 50, a damper 47 and tinsel codes 54, disposed in the vicinity of a joint portion of the voice coil bobbin 41 and the speaker diaphragm 50. For the sake of clarity only one tinsel code 54 is shown, and the same elements as in FIG. 11 are designated with like numerals. A drawback of such a conventional speaker is that the foam resin speaker diaphragm 50 has a poor heat-resisting characteristic, and is easy to melt with heat from the voice coil 46.

The sixth embodiment of the present invention aims to remove the above-mentioned drawback, and is described with reference to FIG. 14.

Figure 14:
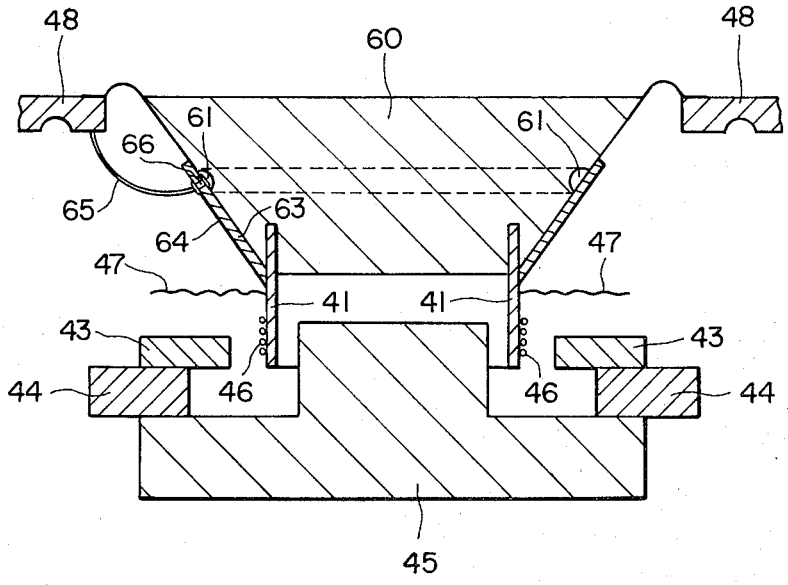
FIG. 14 is a schematic cross-sectional view of a speaker including a sixth embodiment speaker diaphragm assembly according to the present invention.

FIG. 14 is a schematic cross-sectional view of a speaker having the sixth embodiment of the diaphragm assembly. In FIG. 14, a substantially truncated conical speaker diaphragm assembly 60, which may be one of the first to fourth embodiments described has a ring-like recess 61; the recess is in the vicinity of the center of the side surface of the body of the diaphragm assembly 60. A voice coil bobbin 41, made of a material having low thermal conductivity, is disposed at the rear end portion of the body of the diaphragm assembly 60. A sub cone 63, made of a material having low thermal conductivity and formed as a thin layer having a great stiffness, is connected to the side surface of the body of the diaphragm 60 in such a manner that the sub cone 63 abuts against both the voice coil bobbin 41 and the diaphragm body.

On the surface of the sub cone 63 are disposed voice coil lead wires 64, made of a material having a high thermal conductivity. Tinsel codes 65, made of a material having a high thermal conductivity, are secured by soldering or the like to the voice coil lead wires 64 and to the sub cone 63 via respective eyelets 66, or the like. In detail, the sub cone 63 has two through-holes for respectively receiving the eyelets 66 which function as electrical terminals; the positions of the through-holes are selected so that the through-holes are aligned with the ring-like recess 61. The other ends of tinsel codes 65 are respectively connected to speaker terminals (not shown) for receiving a speaker driving current.

Although the speaker of FIG. 14 actually comprises two tinsel codes and two voice coil lead wires, only a single tinsel code 65 and a single lead wire 64 are shown for simplicity. Each of the lead wires 64 is secured to the sub cone 63 by means of a suitable adhesive agent. The above-mentioned sub cone 63 corresponds to the supporting member 42 of the fifth embodiment diaphragm assembly of FIG. 11 as long as the supporting member 42 is made of a material having low thermal conductivity. The same elements as in FIG. 11 are designated by like numersls, and the description thereof is omitted.

As described above, as the voice coil lead wires 64 are connected respectively to the tinsel codes 65 in the vicinity of the recess 61 in the speaker diaphragm body where the sub cone 63 is connected to the side surface of the diaphragm body made of a foam resin, and the lead wires 64 are placed on the sub cone 63, the heat generated in the voice coil 46 is readily dissipated externally through the voice coil lead wires 64 and the tinsel codes 65. Furthermore, since each of the joint portions of the voice coil lead wires 64 and the tinsel codes 65 does not abut against the speaker diaphragm because of the recess 61 formed in the side surface of the diaphragm body, the speaker diaphragm body does not melt with heat to change the shape thereof. In addition, since the low thermal conductivity sub cone 63, is interposed between the voice coil lead wires 64 and the speaker diaphragm body, it is difficult for heat to be conducted to the diaphragm body so that the diaphragm body does not melt and change shape. For instance, a comparison of the conventional foam resin diaphragm 50, which is shown in FIG. 13, with the speaker having the sixth embodiment speaker diaphragm assembly indicates that the diaphragm 50 of FIG. 13 changes shape due to the heat with an output of 35 watts, but that the diaphragm assembly 60 according to the present invention does not change shape even with an output of 55 watts.

Furthermore, as each of the tinsel codes 65 is spaced from the damper 47, members 65 and 47 do not contact so that rustles do not occur and therefore, the sound quality is not adversely effected. Furthermore, since the vibrations of the voice coil 46 are directly transmitted via the voice coil bobbin 41 and the sub cone 63 to the wide area of the speaker diaphragm body, the efficiency of the vibration transmission from the voice coil 46 is superior, and thus the sound quality is superior. In addition, since the sub cone 63 is attached to the side surface of the foam resin diaphragm body, it is difficult to damage the body and the reciprocal movement frequency range is wide because the stiffness of the vibrating system is increased relative to the prior art.

As described above, in accordance with the sixth embodiment of the present invention, by providing recess 61 in the side surface of a foam resin speaker diaphragm body, and a connecting voice coil lead wires 65 to tinsel codes 65 at the recess, enables each joint connecting each of the voice coil lead wires 64 to each of the tinsel codes 65 to be spaced from the speaker diaphragm body. Spacing codes 65 from the joints makes the speaker diaphragm body difficult to damage by heat generated in the voice coil 46. Accordingly, the speaker can be used as a high-output speaker. Moreover, since the tinsel codes 65 and the damper 47 do not abut against each other, rustles do not occur, thereby providing superior sound quality.

What is claimed is:

1. A method of making a speaker diaphragm assembly comprising:

(a) forming a foam resin body having front and rear end portions and a uniform density throughout the inside of said body by heating a first raw material having a relatively great foam magnification; and (b) forming a sound radiating surface portion that is made of the same sort resin as said foam resin and is integrally formed on said front end portion of said body by heating a second raw material resting on the front end portion of the body, the second raw material having a relatively small foam magnification so that the density of said sound radiating surface portion is greater than the density inside of said body.

2. A method of manufacturing a speaker diaphragm, comprising the steps of:

(a) placing a thin layer made of a resin on a lower mold for forming a sound radiating surface of said diaphragm;

(b) placing an upper mold on said lower mold, said upper mold extending upwardly and having a hole at the top thereof for receiving a cap;

(c) putting a raw material of a foam resin, of the same sort as said resin, in said upper mold in such a manner that said raw material is placed on said thin layer;

(d) tightening said cap; and (e) heating said upper and lower molds to effect foaming of said raw material so that said thin layer is welded to the body of said diaphragm made of said foam resin.

3. A method of manufacturing a speaker diaphragm as claimed in claim 2, further comprising the step of:

placing a second thin layer made of said resin on said raw material, after putting said raw material in the upper mold and before tightening said cap.

4. A method of manufacturing a speaker diaphragm made of a foam resin, comprising the steps of:

(a) putting a first raw material of a foam resin, the foam magnification of which is relatively small, in a mold constructed of a lower mold for forming a sound radiating surface of said speaker diaphragm, an upper mold extending upwardly from said lower mold, and a cap to be inserted in a hole made in said upper mold;

(b) putting a second raw material of a foam resin, the foam magnification of which is relatively great, in said mold in such a manner that said second raw material is placed on said first raw material;

(c) tightening said cap; and (d) heating said mold to effect foaming of said first and second raw materials so that said speaker diaphragm having said sound radiating surface, at which the density of the foam resin is greater than that at the inside of said speaker diaphragm, is obtained.

5. A method of manufacturing a speaker diaphragm as claimed in claim 4, further comprising a step of:

putting a third raw material of a foam resin, the foam magnification of which is relatively small, in said mold in such a manner that said third raw material is placed on said second raw material, after putting said second raw material in the mold and before tightening said cap.

6. A speaker diaphragm assembly manufactured by the steps of claim 4 wherein said body has front and rear end portions, said foam resin constituting said body having uniform density throughout the inside of said body; and wherein said sound radiating surface portion made of the same sort resin as said foam resin of said body is integrally formed with said front end portion of said body, the density of said sound radiating surface portion being greater than that at the inside of said body.

7. A speaker diaphragm assembly comprising:

(a) a foam resin body having front and rear end portions, said foam resin having uniform density throughout the inside of said body as is obtained by heating a first raw material having a relatively great foam magnification; and (b) a sound radiating surface portion of the same sort of resin as said foam resin and integrally formed with said front end portion of said body, said foam resin of said sound radiating surface portion having a density greater than that at the inside of said body as formed by heating a second raw material having a relatively small foam magnification.

8. A speaker diaphragm assembly comprising:

(a) a foam resin body having front and rear end portions, said foam resin having uniform density throughout the inside of said body, said foam resin being formed by heating a first raw material having a relatively great foam magnification; and (b) a sound radiating surface portion made of the same sort of resin as said foam resin and integrally formed with said front end portion of said body, said foam resin of said sound radiating surface portion being formed by heating a second raw material having a relatively small foam magnification so that the density of said sound radiating surface portion is greater than that at the inside of said body.

9. A speaker diaphragm assembly as claimed in claim 8, wherein said foam resin is foam styrene.

10. A speaker diaphragm assembly as claimed in claim 8, wherein said sound radiating surface is flat.

11. A speaker diaphragm assembly as claimed in claim 8, wherein the density at the inside of said diaphragm body is equal to or below approximately 0.03 $g/cm^3$, and the density at said sound radiating surface portion is equal to or greater than approximately 0.04 $g/cm^3$.

12. A speaker diaphragm assembly as claimed in claim 11, wherein the density at the inside of said speaker diaphragm body is approximately from 0.01 to 0.03 $g/cm^3$, and the density at said sound radiating surface portion is approximately from 0.05 to 0.1 $g/cm^3$.

13. A speaker diaphragm assembly as claimed in claim 8, wherein the density at said rear end portion, which is opposite to said front end portion, of said diaphragm body is greater than that at the inside of said body.

14. A speaker diaphragm assembly as claimed in claim 13, further comprising a thin layer made of said resin, said thin layer being welded to said rear end portion of said body.

15. A speaker diaphragm assembly as claimed in claim 14, wherein said thin layer welded to said rear end portion is concavely curved.

16. A speaker comprising:

(a) a housing;

(b) a magnetic circuit means having a magnetic gap, said circuit means being connected fixedly to said housing;

(c) a voice coil bobbin reciprocally movable in said magnetic gap;

(d) a voice coil wound around the bobbin;

(e) an electric circuit having electrical connections between said voice coil and speaker terminals;

(f) a damper connected between said voice coil bobbin and said housing; and (g) a diaphragm assembly having a body made of a foam resin, a sound radiating surface portion, and a supporting member, said body having a front end portion integrally formed with said sound radiating surface portion, a rear end portion, and a side surface extending between said sound radiating surface portion and said rear end portion, said rear end portion being fixedly connected to one end of said voice coil bobbin, said supporting member having one end connected to said voice coil bobbin and extending toward said sound radiating surface portion along said side surface to terminate at a point between said sound radiating surface portion and said rear end portion so that said supporting member covers half or less than half of the entire side surface, said supporting member being fixedly connected to said side surface to cover a portion of said side surface close to said rear end portion, said body having front and rear end portions, said foam resin constituting said body having uniform density throughout the inside of said body as formed by heating a first raw material having a relatively great foam magnification, said sound radiating surface portion having a density greater than that at the inside of said body as formed by heating a second raw material having a relatively small foam magnification, the sound radiating surface portion being made of the same sort resin as said foam resin of said body and integrally formed with said front end portion of said body.

17. A speaker as claimed in claim 16, wherein said diaphragm body is of substantially a truncated conical shape, and wherein said supporting member is of substantially a hollow truncated conical shape.

18. A speaker as claimed in claim 16, wherein said foam resin is foam styrene.

19. A speaker as claimed in claim 16, wherein the density of said foam resin at said sound radiating surface portion is greater than that at the inside of said diaphragm body.

20. A speaker as claimed in claim 16, wherein the density of said foam resin at said rear end portion is greater than that at the inside of said diaphragm body.

21. A speaker as claimed in claim 16, wherein said rear end portion comprises a thin layer made of resin of the same sort as said resin used for said diaphragm body, said thin layer being welded to the inside portion of said diaphragm body.

22. A speaker as claimed in claim 16, wherein said supporting member is made of paper.

23. A speaker as claimed in claim 22, wherein the thickness of said supporting member is approximately 1 millimeter.

24. A speaker as claimed in claim 16, wherein said supporting member is made of a metal.

25. A speaker as claimed in claim 24, wherein said metal is aluminum.

26. A speaker as claimed in claim 25, wherein the thickness of said supporting member is from approximately 30 to 50 micrometers.

27. A speaker comprising:

(a) a housing;

(b) a magnetic circuit means having a magnetic gap and connected fixedly to said housing;

(c) a voice coil wound around a voice coil bobbin which is reciprocally movable in said magnetic gap;

(d) electrical circuits for establishing electrical connections between said voice coil and speaker terminals;

(e) a damper connected between said voice coil bobbin and said housing; and (f) a diahragm assembly having a body made of a foam resin, a sound radiating surface portion, and a supporting member, said body having a front end portion integrally formed with said sound radiating surface portion, a rear end portion, and a side surface extending between said sound radiating surface portion and said rear end portion, said rear end portion being fixedly connected to one end of said voice coil bobbin, said supporting member having one end connected to said voice coil bobbin and extending toward said sound radiating surface portion along said side surface to terminate at a point between said sound radiating surface portion and said rear end portion so that said supporting member covers half or less than half of the entire side surface, said supporting member being fixedly connected to said side surface to cover a portion of said side surface close to said rear end portion, said supporting member being made of a material having a low thermal conductivity, a recess on said side surface, said supporting member having through-holes for receiving respective electrical terminal means, the positions of said through-holes being selected so that said through-holes correspond to said recess.

28. A speaker as claimed in claim 27, wherein said electrical circuits comprises lead wires extending from said voice coil, and tinsel codes extending from said speaker terminals, and wherein each of said lead wires is connected to each of said tinsel codes at each of said electrical terminal means.

29. A speaker as claimed in claim 27, wherein each of said electrical terminal means comprises an eyelet.

30. A speaker as claimed in claim 29, wherein each of said lead wires is secured to said supporting member.

* * * * *